United States Patent [19]

Swanberg

[11] 4,416,377

[45] Nov. 22, 1983

[54] CONTROLLED ACCESS PACKAGE

[75] Inventor: Robert H. Swanberg, Montvale, N.J.

[73] Assignee: Union Camp Corporation, Wayne, N.J.

[21] Appl. No.: 356,928

[22] Filed: Mar. 10, 1982

[51] Int. Cl.[3] ..... B65D 5/54

[52] U.S. Cl. ..... 206/602; 206/538; 206/609

[58] Field of Search ..... 206/602, 538, 45.11, 206/45.12, 609, 624, 626, 628; 229/27, 33, 36

[56] References Cited

U.S. PATENT DOCUMENTS 2,472,985 6/1949 Pardee ..... 229/27

3,731,871 5/1973 Buttery et al. ..... 229/27

3,735,916 5/1973 Buttery ..... 229/27

*Primary Examiner*—Steven M. Pollard

*Assistant Examiner*—David Voorhees

*Attorney, Agent, or Firm*—Kane, Dalsimer, Kane, Sullivan and Kurucz

[57] ABSTRACT

A carton formed from a one-piece sheet with a shelf to provide first and second separate layers, particularly suited for a drug manufacturer to provide physicians or patients with a first drug product on the first layer which is used until exhausted after which the shelf can be released and lifted to provide access to a second different drug product.

4 Claims, 6 Drawing Figures

10
15
16
14
22a
22b
17
23a
23b
20
13
21
18
24a
11
24b
19
25a
12
25b
26a
26c
26b
26
27
29a
29b
28
30
31

CONTROLLED ACCESS PACKAGE

BACKGROUND OF THE INVENTION

This invention relates to an improvement in packages and, more particularly, to a carton formed from a one piece sheet with a shelf to provide first and second separate layers particularly suited for a drug manufacturer to provide physicians or patients with a first drug product on the first layer which is used until exhausted after which the shelf can be released and lifted to provide access to a second drug product.

DESCRIPTION OF THE PRIOR ART

In the present carton used for prescription drug pills or capsule strips the two areas of the carton are accessible for the two different drug products. The carton can be peeled open by means of a perforated side wall of the carton and then is reclosable after removing a portion of the contents. In some cases separation is provided by a tray merely laid into the carton.

The drug manufacturer required that the bottom portion of the product not be accessible until the top portion of the drug is exhausted because of a difference in strength of the drug. The carton of the present invention achieves this end by its novel construction.

SUMMARY OF THE INVENTION

The invention comprises a carton formed from a one-piece sheet, particularly suited for packaging two different products separated from each other, which carton comprises:

connected front, bottom, back and cover panels and a front cover closure flap;

end closure flaps at the ends of the carton;

a generally rectangular break-away strip cut-perforated in the top of the front panel; and a shelf panel connected along its back edge to the back panel and connected along its front edge to the top of the break-away strip along a cut-perforated line and by nips at each end to the front panel, the said shelf panel being spaced from the bottom panel to provide separate areas above and below the shelf panel;

the said carton being packaged with one product below the shelf panel and the second product above the shelf panel with the end closure flaps closing the ends of the carton and the front cover closure flap being secured to the break-away strip of the front panel to completely seal the carton;

the said carton being adapted to be opened by raising the front cover closure flap and tearing loose the break-away strip, whereby the first product above the shelf panel will be accessible until exhausted after which the shelf panel can be torn from the nips at each end to provide access to the second product.

DETAILED DESCRIPTION OF THE PREFERRED EMBODIMENT

Figure 1:
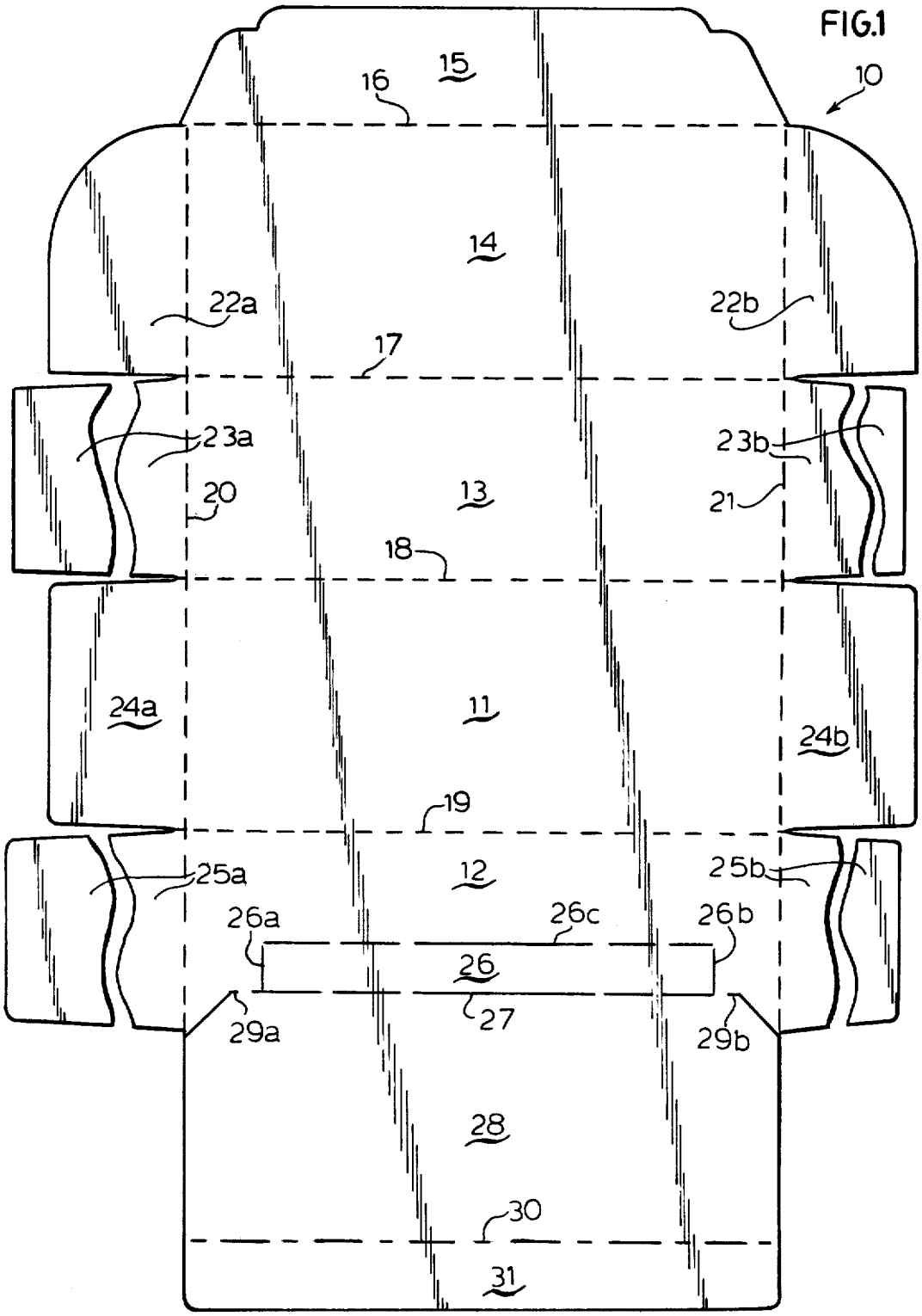
FIG. 1 is a plan view of the blank of the carton of the present invention.

Referring to the drawings there is shown in FIG. 1 a flat substantially rectangular blank of sheet material, such as paperboard or the like of a weight suitable for the type of carton to be constructed. The blank 10 consists of a bottom panel 11, a front panel 12, a back panel 13, a cover panel 14 and a closure clap 15. These panels 15, 14, 13, 11 and 12 are attached together along longitudinal hinge score lines, respectively, 16, 17, 18 and 19. Vertical hinge score lines 20 and 21 attach end closure flaps 22*a* and 22*b* to cover panel 14, 23*a* and 23*b* to back panel 13, 24*a* and 24*b* to bottom panel 11, and 25*a* and 25*b* to front panel 12.

The front panel 12 is provided with a rectangular break-away strip 26, which is partially cut at each end along lines 26*a* and 26*b* and along an inner longitudinal line 26*c*, so that it is only lightly attached to the panel 12. The purpose of this strip will be described hereinafter.

Attached to the break-away strip 26 along an outer longitudinal line 27 is a shelf panel 28. Such line 27 is so cut that the shelf panel 28 is only lightly attached to the strip 26 for the length of the strip, but is secured to the front panel 12 by nips 29*a* and 29*b* at each end of the line 27. Thus the strip 26 is adapted to easily break-away from the front panel 12 and the shelf panel 29 as will be described hereinafter. The shelf panel 28 is perforated along a longitudinal line 30 at its outer edge to provide an adhesive flap 31.

Figure 2:
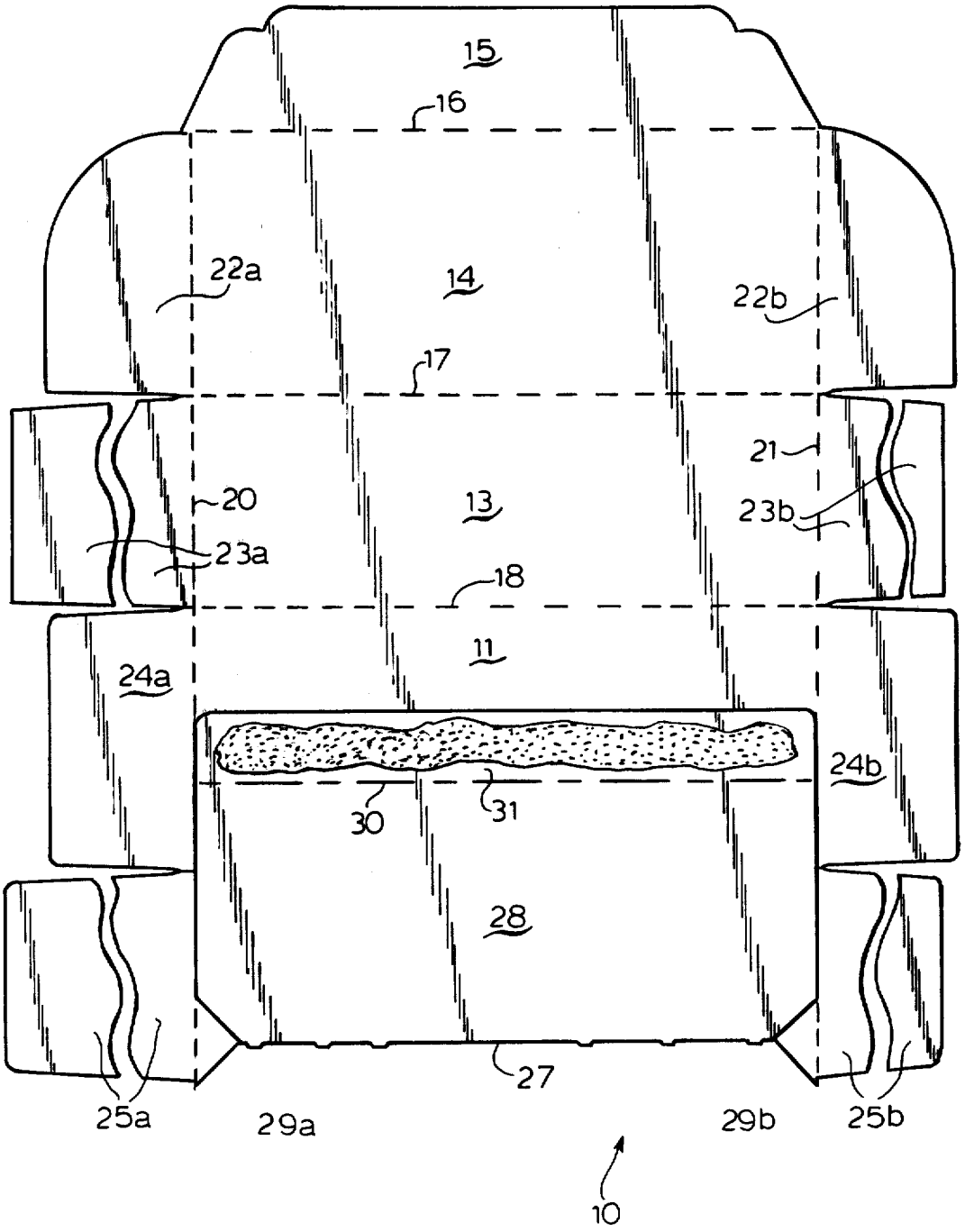
FIG. 2 is a view of the blank of FIG. 1 showing the first step in folding the blank.
Figure 3:
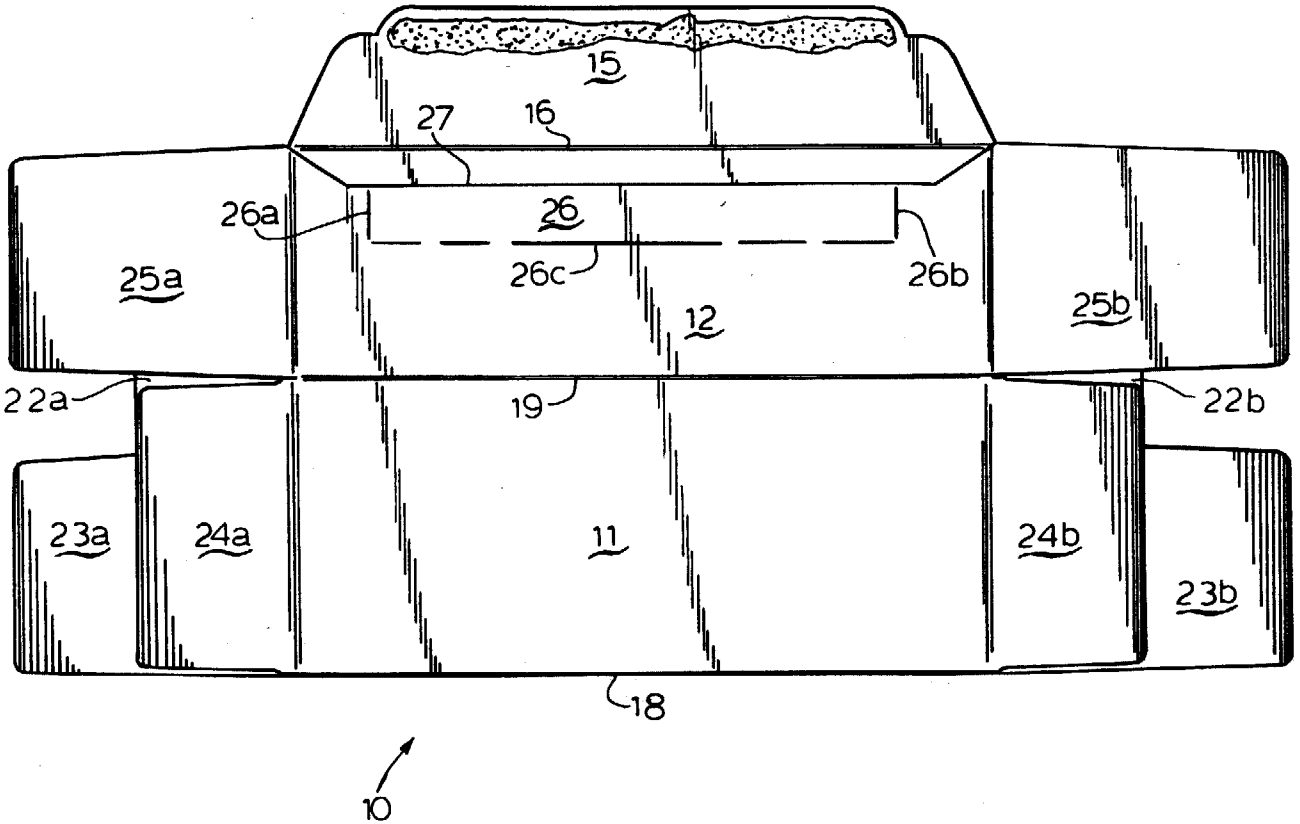
FIG. 3 is a view of the blank of FIG. 1 showing the second step in folding the blank.
Figure 4:
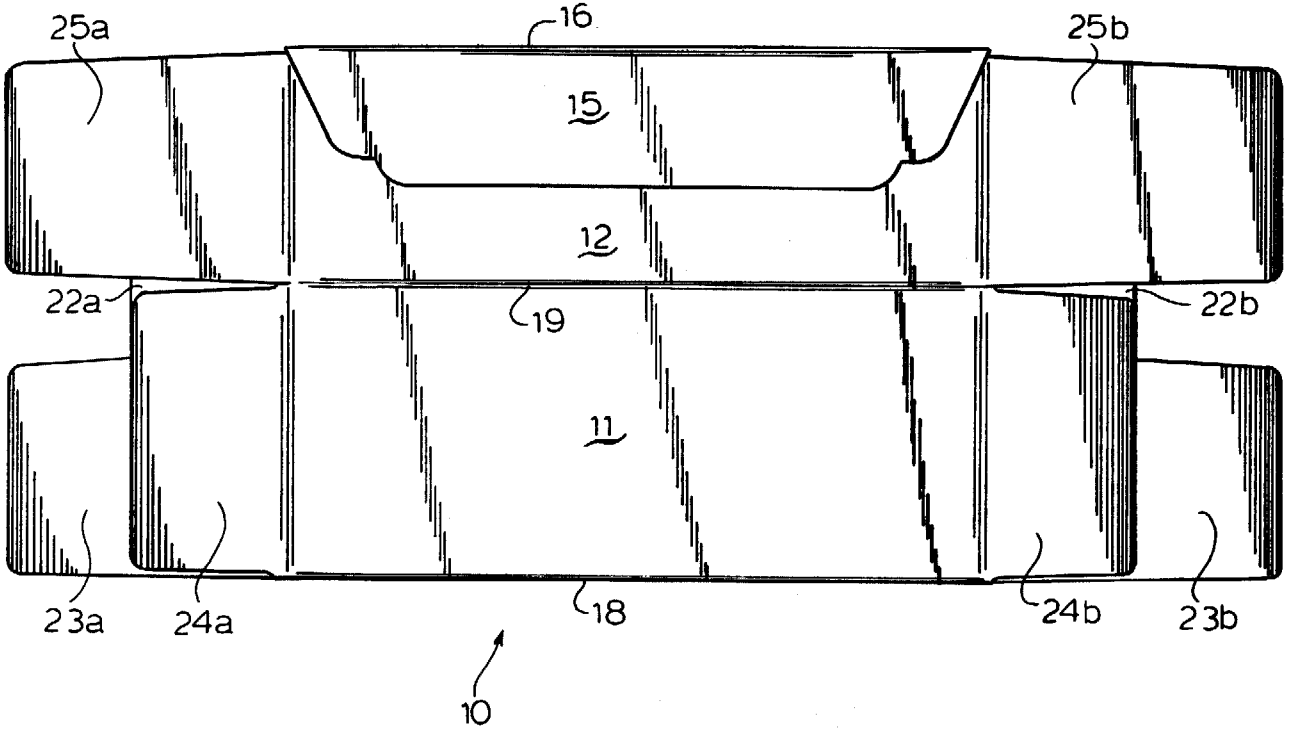
FIG. 4 is a view of the blank of FIG. 1 showing the final step in folding the blank to form the blank which is shipped to the customer for packaging his products.
Figure 5:
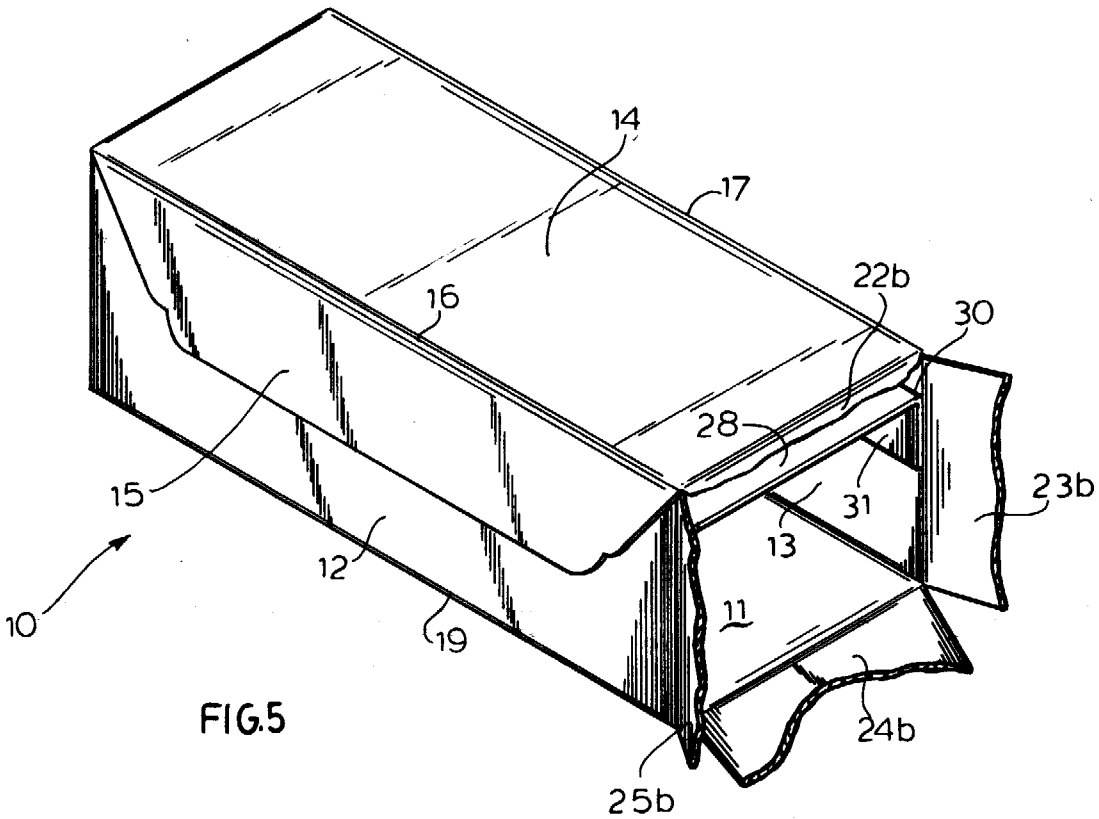
FIG. 5 is a perspective end view of the blank of FIG. 4 set up with one end closed and the opposite end open showing the shelf providing two layers.

The flat blank 10 is prepared by the carton manufacturer for customer use by (1) reverse folding the shelf panel 28 and adhesive flap 31 180° along the line 27 so that they are superimposed on front panel 12 and bottom panel 11 (FIG. 2); (2) applying adhesive to the adhesive flap 31, (3) reverse folding the blank 10 along the line 18 180° so that the adhesive flap 31 will lie against and be secured to the back panel 13 (FIGS. 3 and 4), (4) applying adhesive to the flap 15 (the blank is conventionally printed with a coat of varnish, but strip 26 is "spared out" during the printing operation. Thus, when the flap 15 is applied against the strip 26 and panel 12, the adhesive will adhere only to the strip 26); and (5) reverse folding the flap 15 along the line 16 180° so that flap 15 will lie against and be secured to the strip 26 (FIG. 4). The blank so folded is now in condition for shipment to the customer who can set up the blank into a carton, fold and secure the end closure flaps at one end of the carton (FIG. 5), fill the carton with the two products, and fold and secure the end closure flaps at the other end of the carton. The carton containing the two products is now a sealed package ready for ultimate use by the physician, patient or other end user.

Figure 6:
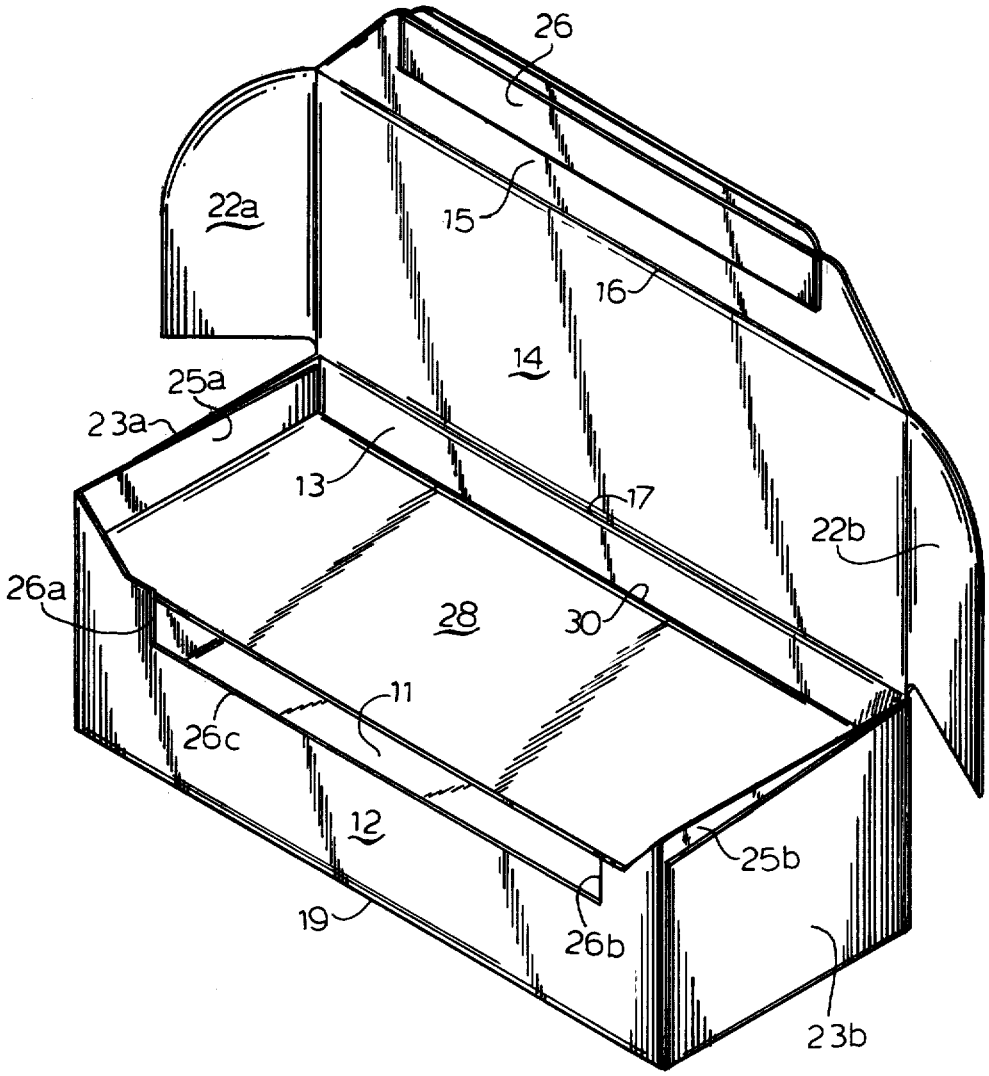
FIG. 6 is a perspective view of the front of the carton with the cover and closure flap raised to show the shelf for holding the first product and the area beneath the shelf for holding the second product.

The ultimate end user grips the flap 15 and pulls it loose from the front panel 12. The break-away strip 26 bonded to the flap 15 will come loose with the flap. When the cover panel 14 and end flaps 22*a* and 22*b* are raised, the top layer of product on the shelf panel 28 will be exposed and available for use (FIG. 6). At this stage the shelf panel 28 is secured at each end by the nips 29*a* and 29*b* to the front panel 12 and will thus remain in a horizontal position generally parallel to the bottom of the carton. Because the strip 26 has been removed there is a gap between the edge of the shelf and the front top edge of the front panel permitting a view of the bottom layer of product. Such gap also serves to permit a finger to be inserted under the shelf to raise such shelf at the proper time.

When the top layer of product has been exhausted. the end user lifts the shelf by tearing it from the nips holding the shelf to the front panel. Since the shelf is only secured to the adhesive flaps 31 by a perforated line, the entire shelf may, if desired, be easily torn along such line to remove the shelf and provide even more complete access to the lower layer of product.

The break-away strip provides a view into the product below the shelf and also permits easily gripping the front edge of the shelf to tear the shelf loose from the end nips and raising such shelf. Although not as satisfactory, such break-away strip can be omitted, in which case the front edge of the shelf is connected to the top of the front panel along a cut-perforated line. The front cover closure flap is secured to the front panel with means, such as a tear strip, to permit the flap to be torn from the front panel. Until the shelf is raised the product below the shelf will not be visible. It may be desirable in this construction to provide a thumb hole at the end of the shelf to facilitate gripping the shelf for raising.

Those skilled in the art will appreciate that many variations of the above described embodiment of the invention may be made without departing from the spirit and scope of the invention.

What is claimed:

1. A carton formed from a one-piece sheet, particularly suited for packaging two different products separated from each other, comprising:

connected front, bottom, back and cover panels and a front cover closure flap;

end closure flaps at the ends of the carton;

a generally rectangular break-away strip cut-perforated in the top of the front panel; and a shelf panel connected along its back edge to the back panel and connected along its front edge to the top of the break-away strip along a cut-perforated line and by nips at each end to the front panel, the said shelf panel being spaced from the bottom panel to provide separate areas above and below the shelf panel;

the said carton being packaged with one product below the shelf panel and the second product above the shelf panel with the end closure flaps closing the ends of the carton and the front cover closure flap being secured to the break-away strip of the front panel to completely seal the carton;

the said carton being adapted to be opened by raising the front cover closure flap and tearing loose the break-away strip, whereby the first product above the shelf panel will be accessible until exhausted after which the shelf panel can be torn from the nips at each end to provide access to the second product.

2. The carton of claim 1 in which the shelf panel is connected along its back edge of the back panel along a cut-perforated line whereby the shelf panel can be removed from the carton to provide access to the second product.

3. A one-piece tubular blank made from a generally rectangular sheet adapted to be shipped in flat form and set up into a carton, particularly suited for packaging two different products separated from each other, comprising:

connected front, bottom, back and cover panels and a front cover closure flap;

end closure flaps at the ends of the carton;

a generally rectangular break-away strip cut-perforated in the top of the front panel; and a shelf panel connected along its back edge to the back panel and connected along its front edge to the top of the break-away strip along a cut-perforated line and by nips at each end to the front panel, the said shelf panel being spaced from the bottom panel to provide separate areas above and below the shelf panel;

the front cover closure flap being secured to the break-away strip of the front panel to provide a tubular blank open at both ends;

the said blank being adapted to be set up into a carton, packaged with one product below the shelf panel and the second product above the shelf panel and closed at both ends with the end closure flaps to completely seal the carton;

the said carton being adapted to be opened by raising the front cover closure flap and tearing loose the break-away strip, whereby the first product above the shelf panel will be accessible until exhausted after which the shelf panel can be torn from the nips at each end to provide access to the second product.

4. The blank of claim 3 in which the shelf panel is connected along its back edge to the back panel along a cut-perforated line whereby the shelf panel can be removed from the carton to provide access to the second product.

* * * * *